US010099281B2

(12) United States Patent
Uehara et al.

(10) Patent No.: US 10,099,281 B2
(45) Date of Patent: Oct. 16, 2018

(54) CASTING DIE DEVICE AND CASTING METHOD

(71) Applicant: KEIHIN CORPORATION, Tokyo (JP)

(72) Inventors: Tetsuya Uehara, Iwanuma (JP); Fumihiro Sakuma, Shiroishi (JP)

(73) Assignee: KEIHIN CORPORATION, Tokyo (JP)

( * ) Notice: Subject to any disclaimer, the term of this patent is extended or adjusted under 35 U.S.C. 154(b) by 167 days.

(21) Appl. No.: 15/101,119

(22) PCT Filed: Nov. 19, 2014

(86) PCT No.: PCT/JP2014/080583

§ 371 (c)(1),
(2) Date: Jun. 2, 2016

(87) PCT Pub. No.: WO2015/083543

PCT Pub. Date: Jun. 11, 2015

(65) Prior Publication Data

US 2016/0339513 A1 Nov. 24, 2016

(30) Foreign Application Priority Data

Dec. 6, 2013 (JP) ..... 2013-253676

(51) Int. Cl.
*B22D 27/08* (2006.01)
*B22D 17/24* (2006.01)
(Continued)

(52) U.S. Cl.
CPC ..... *B22D 17/10* (2013.01); *B22C 9/101* (2013.01); *B22D 17/24* (2013.01); *B22D 27/08* (2013.01)

(58) Field of Classification Search
CPC ..... B22C 9/10; B22C 9/101; B22D 17/22; B22D 17/24; B22D 27/08
(Continued)

(56) References Cited

U.S. PATENT DOCUMENTS 3,181,211 A * 5/1965 Rearwin ..... B22D 17/22 164/511
5,615,726 A * 4/1997 Ota ..... B22C 9/101 164/132

FOREIGN PATENT DOCUMENTS

JP 03124358 A * 5/1991
JP 05-096511 12/1993
(Continued)

OTHER PUBLICATIONS

International Search Report, dated Jan. 27, 2015 (Jan. 27, 2015).

*Primary Examiner* — Kevin E Yoon
(74) *Attorney, Agent, or Firm* — Rankin, Hill & Clark LLP

(57) ABSTRACT

The present invention relates to a casting die device and a casting method used to obtain a cast product in which an inner bore, at least one end of which is open, is formed. The casting die device has a core pin for forming the inner bore in the cast product, and a vibration-transmitting member for transmitting vibrations from a vibrator of a micro-vibration machine to the core pin. When casting is being performed, vibrations from the vibrator are imparted to the core pin by way of the vibration-transmitting member. The vibrations also propagate to sites surrounding the core pin, in molten metal that has been poured into a cavity.

2 Claims, 7 Drawing Sheets

(51) Int. Cl.
*B22D 17/10* (2006.01)
*B22C 9/10* (2006.01)

(58) Field of Classification Search
USPC ..... 164/71.1, 113, 260, 303–318, 501; 228/1.1, 110.1
See application file for complete search history.

(56) References Cited

FOREIGN PATENT DOCUMENTS

| | | |
|---|---|---|
| JP | 07-001102 | 1/1995 |
| JP | 2000-094114 | 4/2000 |
| JP | 2000-238041 | 9/2000 |
| JP | 2006-289486 | 10/2006 |
| JP | 2008-229638 | 10/2008 |

* cited by examiner

CASTING DIE DEVICE AND CASTING METHOD

TECHNICAL FIELD

The present invention relates to a casting die device and a casting method for obtaining a cast product in which an inner bore, at least one end of which is open, is formed.

BACKGROUND ART

For example, a valve body that constitutes a spool valve has been manufactured by pouring a molten metal (principally a molten metal of an aluminum alloy) into a cavity of a casting die device, and allowing the molten metal to harden. Stated otherwise, the valve body is obtained as a cast product.

In the case of this type of valve body, a valve hole (inner bore) is formed for slidable insertion therein of a spool that makes up a valve member. At least one end of the valve hole is opened at a predetermined location in the valve body so as to allow the spool to be inserted therein.

The valve hole is formed, for example, by a core pin. More specifically, the core pin is inserted beforehand into the interior of a cavity, and in this state, the molten metal is poured into the cavity. Then, after the molten metal has hardened and a cast product is obtained, the core pin is removed or separated away from the cast product, whereby a hollow portion is formed having a shape corresponding to the shape of the core pin. The hollow portion serves as the valve hole.

In this case, on the casting surface of the valve hole, typically casting defects such as blowholes or flow lines are formed therein. Therefore, with respect to an inner wall of the valve hole, a location up to a depth of about 0.5 mm to 1 mm is removed by a grinding process, and an operation to expose the inner part of the inner wall is carried out extensively. More specifically, in the spool valve as a product to be distributed, the surface of the inner wall of the valve hole is a machined surface that is exposed by grinding.

However, on such a machined surface, cases may occur in which casting defects such as blowholes or the like that exist in the vicinity of the machined surface (in inner layers of the valve hole) become exposed. Consequently, for eliminating casting defects in the machined surface, there is a need to reduce the occurrence of such casting defects as much as possible in the inner layers of the valve hole.

In Japanese Laid-Open Patent Publication No. 2000-238041, it is disclosed to immerse a die to which ultrasonic vibrations are applied into a molten metal. According to the disclosure of Japanese Laid-Open Patent Publication No. 2000-238041, in this condition, when the die is pulled out from the molten metal, a state is maintained in which the molten metal adheres to the die. Further, according to Japanese Laid-Open Patent Publication No. 2000-238041, by continuing to apply the ultrasonic vibrations until a certain degree of hardening has taken place following die matching (die closure), it is disclosed that the occurrence of casting defects such as blowholes, flow lines or the like can be reduced.

However, even if vibrations are applied to the die as disclosed in Japanese Laid-Open Patent Publication No. 2000-238041, such vibrations often are not transmitted sufficiently to the molten metal. More specifically, merely by imparting vibrations to the mold, it is not easy for casting defects in the inner wall and inner layers of the inner bore to be reduced.

SUMMARY OF INVENTION

As can be understood from the above, with the conventional casting technology, it is extremely difficult to form an inner bore in which casting defects in the inner wall and inner layers thereof cannot be recognized.

The above disadvantage is not limited to a valve hole of the valve body, and for example, similar defects can occur in a sliding hole for a piston in an actuator or the like, or in an intake path of a throttle body or a carburetor, etc.

A principal object of the present invention is to provide a casting die device in which vibrations can be transmitted adequately with respect to a molten metal.

Another object of the present invention is to provide a casting die device, which enables a casting product to be obtained in which casting defects in the inner wall of an inner bore can be reduced.

A still further object of the present invention is to provide a casting method in which the above-described casting product can be obtained.

According to an embodiment of the present invention, a casting die device is provided for obtaining a cast product, an inner bore being formed in the cast product, at least one end of the inner bore being open, comprising:

a core pin configured to form the inner bore;

a vibration generating unit configured to generate vibrations; and a vibration transmitting member supported by a die that forms a cavity, and configured to transmit the vibrations generated by the vibration generating unit to the core pin.

Further, according to another embodiment of the present invention, a casting method is provided for obtaining a cast product, an inner bore being formed in the cast product, at least one end of the inner bore being open, the method comprising the steps of:

forming a cavity, a core pin having entered the cavity for forming an inner bore; and introducing molten metal into the cavity;

wherein vibrations generated by a vibration generating unit are imparted to the molten metal in, interior of the cavity through the core pin and/or a vibration transmitting member that is supported by a die that forms the cavity.

The term "inner bore" Includes the meanings of a through hole both ends of which are open, and a bottomed hole one end of which is closed. Further, the terms "sound surface" and "sound layer" as used below refer to surfaces and layers in which casting defects, such as blow holes or flow lines, etc., of a size that results in leakage of the material from the inner bore, are not recognized.

More specifically, in the present invention, a structure is adopted in which the vibrations generated by the vibration generating means are transmitted through the vibration transmitting member to the core pin, and furthermore, such vibrations can be transmitted from the core pin to the molten metal in the interior of the cavity. Accordingly, the vibrations are transmitted sufficiently to the molten metal. More specifically, the inner wall of the inner bore that is formed by the core pin is constituted by hardening of the molten metal in a state in which vibrations are imparted adequately thereto.

The inner wall (casting surface), which is formed in this manner, exhibits a surface luster, and casting defects, such as blow holes or flow lines, etc., having a size of a degree that causes leakage of the underlying material (for example, hydraulic oil or the like) of the inner bore, are not recognized therein. More specifically, the inner wall is a sound surface in which casting defects cannot be recognized, and moreover, the aesthetic appearance thereof is favorable. This is because, in the manner described above, vibrations are transmitted sufficiently.

Consequently, depending on the circumstances, it is possible for the casting surface to be used directly without performing a grinding process or a mirror polishing process thereon. Therefore, the number of steps required until a cast product is rendered as a final product can be reduced, together with achieving a reduction in costs. Further, in this case, since grinding dust is not generated, material yield is improved.

Further, in this case, the amount of burrs also is reduced. In addition to this advantage, since there is no need for a grinding process to be performed, grinding dust is not generated. Thus, material yield is enhanced.

Furthermore, with the cast product, an interior portion thereof up to a predetermined depth from the casting surface generally forms a sound layer. More specifically, in the interior portion as well, up to a predetermined depth from the casting surface, casting defects having a size of a degree that causes leakage of the underlying material cannot be recognized. Consequently, for example, a predetermined depth on the order of roughly half (of the sound layer) may be removed by a grinding process, and a newly exposed surface (processed surface) may be provided as the inner wall of the inner bore.

In this case as well, in the same manner as described above, it is possible to prevent leakage of the underlying material. This is because the new inner wall, which is formed by exposure of the inner portion that was a sound layer, also is a sound surface.

Although the core pin and the vibration transmitting member can be constituted as separate members, they may also be constituted as an integral structure made from the same material. In this case, there is an advantage in that the structure is simplified.

As the vibration generating unit, for example, a microvibration machine can be used that generates mechanical vibrations having an oscillation frequency of one hundred to several hundreds Hz. Alternatively, an ultrasonic vibration machine that generates ultrasonic vibrations may be used.

Further, when pouring of molten metal into the cavity is carried out, preferably a pressure is applied to the metal. More specifically, the casting die device preferably is a high pressure casting die device, and the casting method preferably is a high pressure die casting (HPDC) method.

DESCRIPTION OF EMBODIMENTS

Preferred embodiments of a casting method according to the present invention, and a casting die device for implementing the aforementioned casting method will be described in detail below with reference to the accompanying drawings. In relation to the present embodiments, a valve body that constitutes a spool valve will be presented as an example of a cast product produced thereby.

Figure 1:
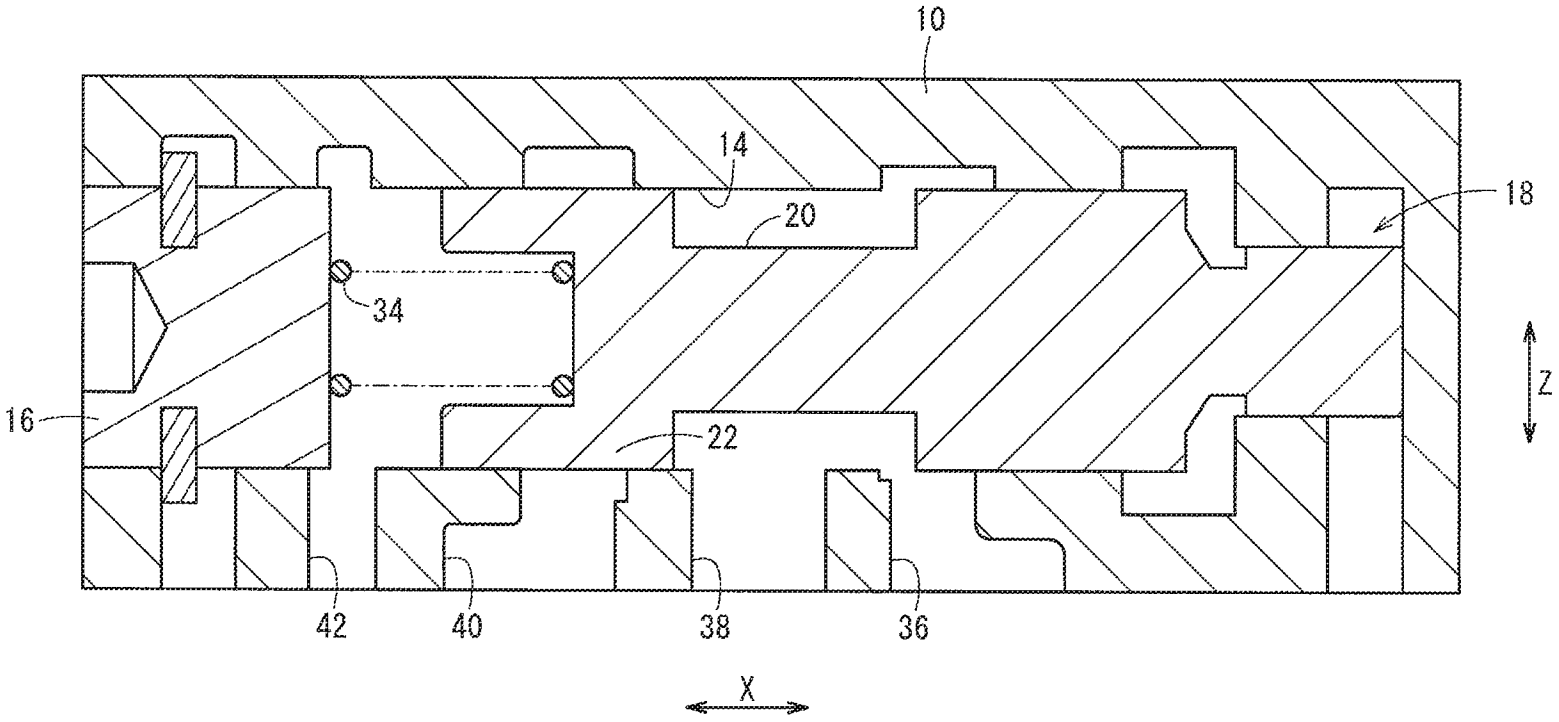
FIG. 1 is a vertical cross-sectional view taken along a thickness direction of a spool valve equipped with a valve body (casting product), which is obtained by a casting method according to an embodiment of the present invention.

Initially, a spool valve will be described with reference to FIG. 1. FIG. 1 is a vertical cross-sectional view taken along a thickness direction (the direction of the arrow Z in FIG. 1) of a spool valve 12 that includes a valve body 10 defining a casting product. In the valve body 10, a valve hole 14 is formed as an inner bore, which extends along an axial direction, for example, a longitudinal direction (the directions of the arrow X in FIG. 1).

The valve hole 14 opens on one end in the direction of the arrow X. The opened one end thereof is closed by a cap member 16. The remaining one end thereof is closed by an inner wall of the valve body 10. The inner wall functions as a stopper wall that blocks or occludes a spool 18 (valve member).

In the valve body 10, there are formed an inlet port 36 through which a hydraulic oil is introduced into the interior of the valve hole 14, an outlet port 38 through which the hydraulic oil is led out from the valve hole 14, a drain port 40, and a hydraulic oil supply port 42 that is formed from another valve (not shown). In FIG. 1, a state is shown in which the spool 18 is biased resiliently by a pressure-regulating spring 34, one end surface of which abuts against (contacts or is blocked by) a stopper wall. At this time, the inlet port 36 and the outlet port 38 are placed in communication with each other through an annular groove 20 of the spool 18. On the other hand, the drain port 40 is closed or sealed by a large diameter portion 22.

Figure 2:
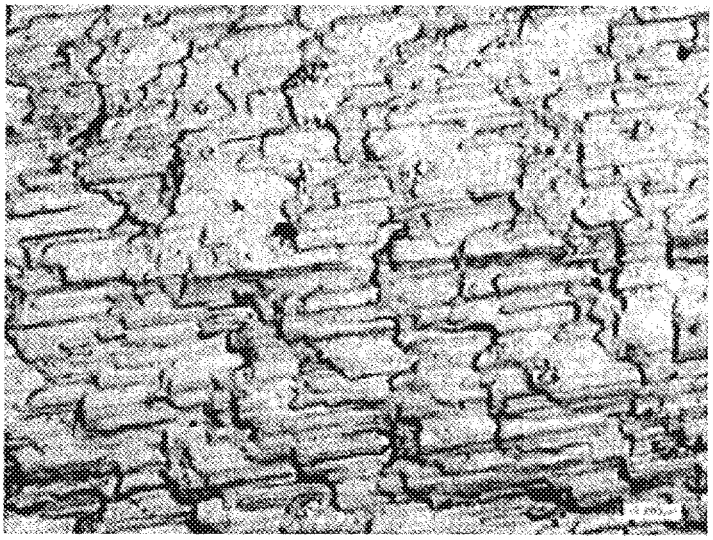
FIG. 2 is a high magnification laser microscopic photograph of an inner wall of a valve hole (inner bore) that is formed in the valve body.

The inner wall of the valve hole 14 defines a casting surface that exhibits a metallic luster. Further, as can be understood from FIG. 2, which is a high magnification laser microscopic photograph of the inner wall (casting surface), blow holes or flow lines, etc., having a size of a degree that causes leakage of hydraulic oil, are not recognized on the inner wall (casting surface). More specifically, despite it being a casting surface that is not subjected to a grinding process or a mirror polishing process or the like, the inner wall forms a sound surface in which casting defects cannot be recognized, and moreover, the aesthetic appearance thereof is favorable.

Figure 3:
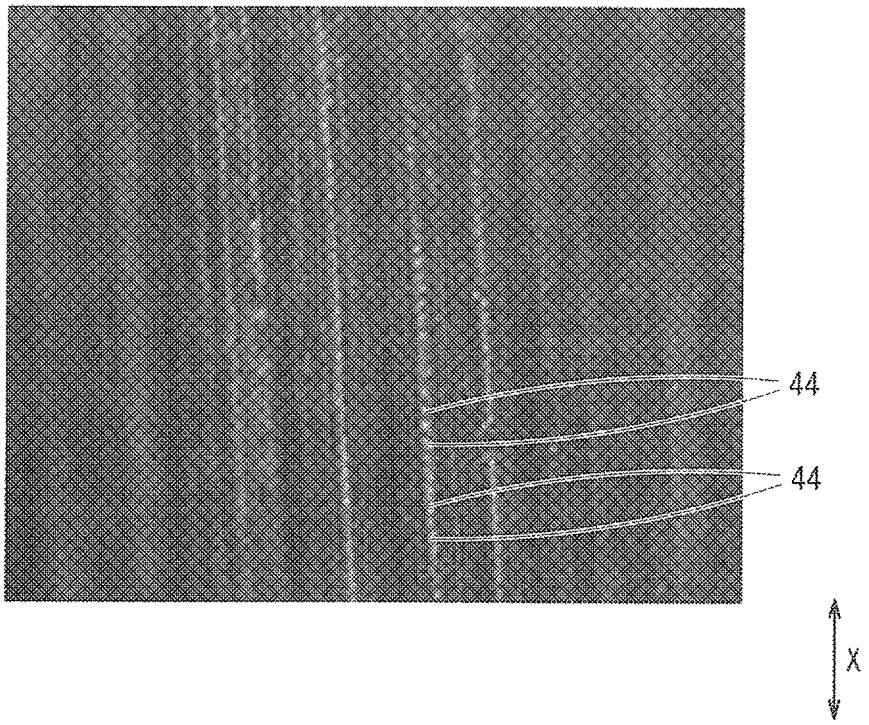
FIG. 3 is a low magnification laser microscopic photograph of an inner wall of a valve hole (inner bore) that is formed in the valve body.

Furthermore, as shown in FIG. 3, on the casting surface that forms the inner wall, a plurality of fine lines 44, which can be recognized visually when observed at low-magnification using a laser microscope, extend in a direction perpendicular to the longitudinal direction (the direction of the arrow X). Such lines 44 cannot be observed on the inner wall of a valve hole that is formed without application of vibrations. More specifically, the lines 44 are believed to be formed based on the application of such vibrations. Moreover, the lines 44 do not contribute to leakage.

As will be discussed later, the valve hole 14 is formed by a core pin 46 (see FIG. 4) to which vibrations are applied. The interval of separation between the adjacent lines 44 is presumed to correspond to the vibration frequency.

Furthermore, casting defects having a size of a degree that causes leakage of hydraulic oil, cannot be recognized to a depth of at least 1 mm from the inner wall surface of the valve hole 14 that forms the casting surface. More specifically, in the valve body 10, the interior portion thereof reaching to a depth of 1 mm from the inner wall surface of the valve hole 14 is a so-called sound layer.

Consequently, the casting surface itself can be utilized as the inner wall of the valve hole 14. Stated otherwise, there is no particular need to carry out a complex operation such as grinding or the like with respect to the casting surface of the valve hole 14. Further, as a result, the number of steps until a practically usable valve body 10 is obtained can be reduced, together with achieving a commensurate reduction in costs. However, with respect to the inner wall of the valve hole 14, a grinding process may be performed thereon, as will be described later.

The valve body 10, in which the valve hole 14 (inner bore) having such an inner wall (casting surface) is formed, can be manufactured by the casting operation to be described below.

Figure 4:
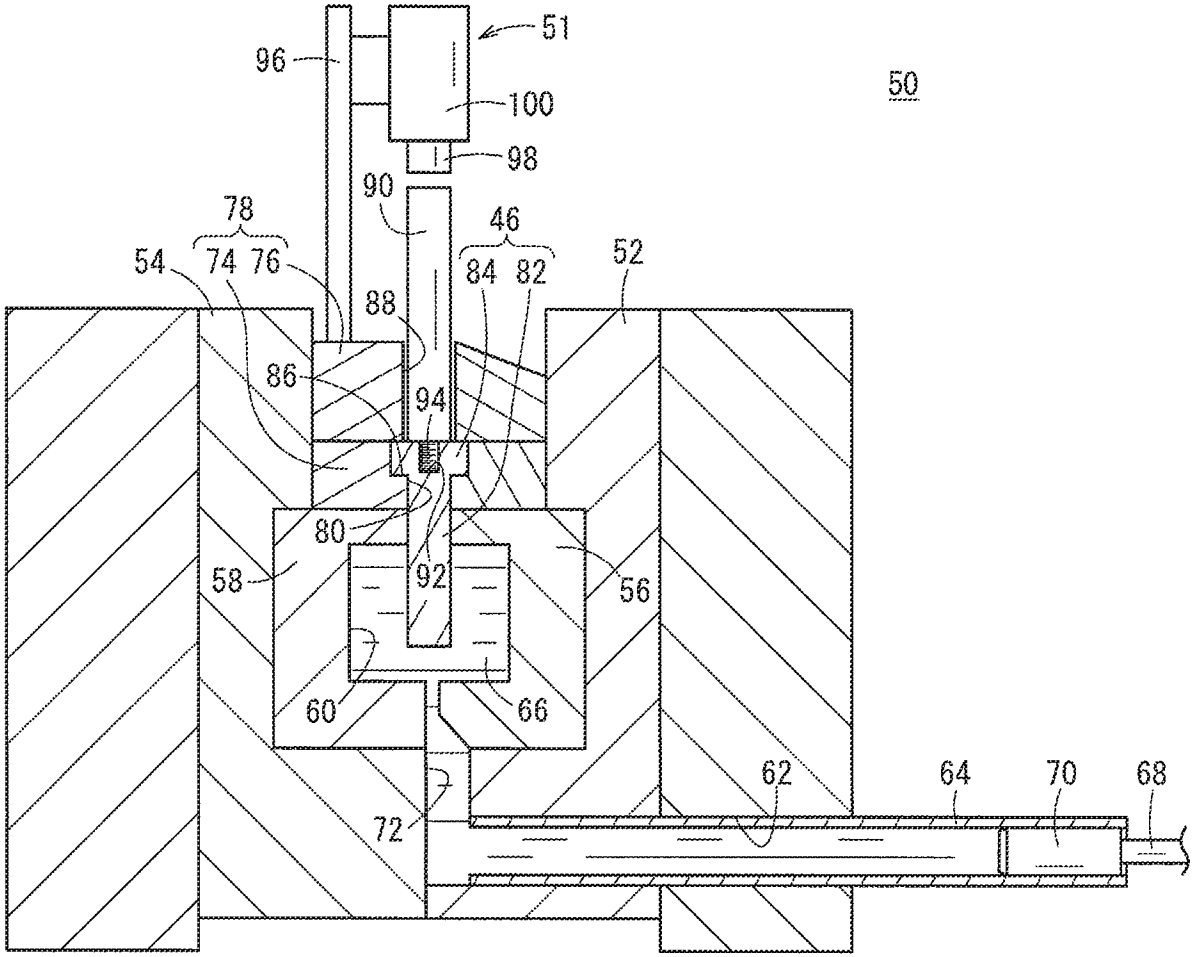
FIG. 4 is a vertical cross-sectional view of essential parts of a casting die device according to an embodiment of the present invention.

FIG. 4 is a vertical cross-sectional view of essential parts of a casting die device 50 according to the present embodiment by which the valve body 10 is obtained. A vibration device 51 is attached to the casting die device 50.

First, as will be described concerning the casting die device 50, for example, the casting die device 50 is a high pressure casting die device to which a pressure of 35 to 100 MPa is applied with respect to a molten metal, and includes a stationary die 52 whose position is fixed, and a movable die 54 that is displaced in directions to approach toward or separate away from the stationary die 52. A first insert 56 is disposed in the stationary die 52, whereas a second insert 58 is disposed in the movable die 54. Accompanying die closure, a cavity 60 is formed by the first insert 56 and the second insert 58.

An insertion hole 62 is formed to penetrate through the stationary die 52, and a plunger sleeve 64 is inserted through the insertion hole 62. A molten metal supply port is formed on an upper end of the plunger sleeve 64, whereby molten metal (e.g., a molten aluminum alloy) 66 is supplied into the plunger sleeve 64 from the molten metal supply port.

In the interior of the plunger sleeve 64, a plunger tip 70, which is connected to a rod 68 of a non-illustrated injection cylinder, is arranged for sliding movement therein. Accordingly, the molten metal 66 that is supplied to the interior of the plunger sleeve 64 is pushed out by the plunger tip 70. Furthermore, from the distal end of the plunger sleeve 64 up to the cavity 60, a runner 72 is formed, which makes up a passage for guiding the molten metal 66 that is introduced from the plunger sleeve 64 into the cavity 60.

In the casting die device 50, there are further provided a pin retaining member 74 that retains the core pin 46, and a core 78 having a strut supporting member 76 connected to the pin retaining member 74. The core 78 is capable of being displaced upwardly and downwardly in FIG. 4 under the action of a non-illustrated slide mechanism provided on the strut supporting member 76.

The vibration device 51 is provided on the core 78. More specifically, on the pin retaining member 74 that constitutes the core 78, a stepped hole 80 is formed to penetrate therethrough in a direction extending toward the cavity 60. The core pin 46, which includes a shaft portion 82 and a head portion 84 that is slightly enlarged in diameter, is inserted through the stepped hole 80. As a result of the head portion 84 of the core pin 46 being supported on a step 86 of the stepped hole 80, the core pin 46 is retained in the pin retaining member 74. Consequently, the core pin 46 is displaced integrally with the core 78, whereby a distal end of the shaft portion 82 of the core pin 46 enters into the cavity 60 at the time of die closure. The valve hole 14 (see FIG. 1) is formed by the distal end of the shaft portion 82.

The shaft portion 82 of the core pin 46 is formed in a straight shape whose outer circumference has no draft, and therefore, the valve hole 14 similarly is formed in a straight shape. In this case, in comparison with a valve hole having a tapered shape with a draft, processing thereof is simplified, and the amount of processing can be reduced.

Further, in the strut supporting member 76, a through hole 88 is formed that is connected in a straight line shape with respect to the stepped hole 80. An elongated rod-shaped vibration transmitting member 90 is inserted through the through hole 88. As a result, the vibration transmitting member 90 is supported in the core 78.

A screw hole 92 is formed in the head portion 84 of the core pin 46. On the other hand, a screw member 94 is provided on a lower end surface of the vibration transmitting member 90, and the screw member 94 is screw-engaged in the screw hole 92. Accordingly, the vibration transmitting member 90 is connected to the core pin 46.

The core pin 46 and the vibration transmitting member 90 may be constituted as an integral structure that made up from the same material. In this case, there is an advantage in that the structure is simplified.

Between the stepped hole 80 and the core pin 46, as well as between the through hole 88 and the vibration transmitting member 90, a certain amount of play on the order of 0.01 to 0.1 mm is formed. Consequently, the core pin 46 and the vibration transmitting member 90 can be subjected to swinging and rotation within the stepped hole 80 and the through hole 88.

An upper end part of the vibration transmitting member 90 projects out in an exposed manner from the through hole 88. Further, a strut 96 is erected on the strut supporting member 76. A microvibration machine 100 of the vibration device 51 having a vibrating element 98 made up, for example, from an air vibrator is supported on the strut 96. In a state in which the vibrating element 98 is stopped, the lower end surface thereof is separated by a predetermined distance with respect to the upper end surface of the vibration transmitting member 90.

When the microvibration machine 100 is energized, the vibrating element 98 thereof is moved up and down at a predetermined period that is set in advance. The stroke of the vibrating element 98 is slightly greater than the separation distance between the vibrating element 98 and the vibration transmitting member 90, and therefore when lowered, the vibrating element 98 abuts against the vibration transmitting member 90. Of course, when it is raised, the vibration element 98 separates away from the vibration transmitting member 90. In this manner, by repeatedly carrying out abutment and separation of the vibrating element 98, vibrations at a predetermined frequency are imparted to the vibration transmitting member 90.

From the fact that the vibrating element 98 and the vibration transmitting member 90 are separated by a predetermined distance, collision energy is generated when the vibrating element 98 abuts against the vibration transmitting member 90. It is presumed that vibrations of a predetermined frequency to which such collision energy is added are imparted to the vibration transmitting member 90.

The casting operation for obtaining the valve body 10, more specifically the casting method according to the present embodiment, is implemented in the manner described below, using the casting die device 50, which is constructed basically as described above.

At first, the movable die 54 is displaced so as to approach with respect to the stationary die 52, and furthermore, the core 78 is lowered to bring about die closure. Accompanying closure of the die, the core pin 46 enters into the cavity 60 that is formed by the first insert 56 and the second insert 58.

Next, the microvibration machine 100 is energized, whereby the vibrating element 98 is made to move up and down. When lowered as described above, the vibrating element 98 comes into abutment against the vibration transmitting member 90, and when raised, separates away from the vibration transmitting member 90. Therefore, vibrations of a predetermined, frequency are imparted to the vibration transmitting member 90. The vibrations, for example, are mechanical vibrations, the frequency of which is one hundred to several hundreds Hz. Further, since a certain amount of play exists between the vibration transmitting member 90 and the inner wall of the through hole 88, as well as between the core pin 46 and the inner wall of the stepped hole 80, the vibration transmitting member 90 and the core pin 46 are capable of being subjected to a swinging operation in the diametral direction, and a rotating operation in the circumferential direction.

In this state, the molten metal 66 (for example, a molten aluminum alloy) is supplied from the molten metal supply port that is formed in the plunger sleeve 64. After a predetermined amount of the molten metal 66 has been introduced into the interior of the plunger sleeve 64, the non-illustrated injection cylinder is energized. In following relation thereto, the plunger tip 70 is slid in a direction to press on the molten metal 66.

As a result, the molten metal 66 that is supplied to the interior of the plunger sleeve 64 is pushed out by the plunger tip 70, is guided in the runner 72, and reaches the cavity 60. More specifically, the molten metal 66 is supplied to the cavity 60, and the cavity 60 is filled with the molten metal 66. In other words, according to the present embodiment, pressure is applied with respect to the molten metal 66 in the interior of the plunger sleeve 64, and thus high pressure die casting (HPDC) is carried out by which the molten metal 66 is introduced into the cavity 60.

Thereafter, the molten metal 66 in the interior of the cavity 60 becomes solidified. Consequently, the valve body 10 is obtained having a shape that corresponds to the shape of the cavity 60. Further, the valve hole 14 is formed at a location corresponding to the core pin 46.

After a predetermined time has elapsed from termination of supply of the molten metal 66 to the cavity 60, the core 78 is raised, together with a die-open condition being brought about by the movable die 54 being separated away from the stationary die 52. As a result, the valve body 10 is exposed.

In this instance, the core pin 46 enters into the cavity 60. In the present embodiment, since vibrations are applied with respect to the core pin 46 as described above, within the molten metal 66 that is introduced into the cavity 60, vibrations are imposed reliably through the core pin 46 with respect to a region that surrounds the core pin 46 (hereinafter referred to as a "core pin surrounding region"). More specifically, the core pin surrounding region that forms the inner wall of the valve hole 14 can be vibrated directly.

When separated away from the vibrating element 98, the core pin 46 is pressed by the viscoelasticity of the core pin surrounding region (the molten metal 66), and is returned substantially to its original position.

Such imparting of vibrations is continued until die opening is carried out. Consequently, vibrations are continuously imparted to the core pin surrounding region, i.e., the region where the inner wall of the valve hole 14 is formed, until a solid phase (solidification) is brought about from the time that contact with the core pin 46 occurs. Since the operation of swinging of the core pin 46 in the diametral direction, or of rotating the core pin 46 in the circumferential direction is easily carried out, vibrations can easily be propagated, in particular, with respect to the diametral direction or the circumferential direction of the core pin 46.

As a result of propagation of vibrations in this manner, the inner wall of the valve hole 14 exhibits a surface luster, and a casting surface (sound surface) can be formed, in which (casting defects, such as) blow holes or flow lines, etc., having a size of a degree that causes leakage of hydraulic oil, are not recognized therein. As described above, this is because the core pin surrounding region is vibrated sufficiently. In addition, in the casting surface, the plural lines 44 (see FIG. 3) are formed in a direction perpendicular to the axial direction (the extraction direction of the core pin 46). The interval of separation between the adjacent lines 44 is presumed to correspond to the vibration frequency of the vibrating element 98.

In a general casting technique in which imparting of vibrations thereto is not carried out, casting defects tend to exist in the inner wall (casting surface) of the valve hole 14 immediately after the core pin 46 has been withdrawn. Consequently, if the casting surface is left with the inner wall in this state, there is a concern that hydraulic oil will leak out.

In contrast thereto, according to the present embodiment, the casting surface is formed as a sound surface in which casting defects as described above cannot be recognized. Accordingly, there is no need to carry out an operation such as grinding or the like with respect to the inner wall (casting surface) of the valve hole 14, and the inner wall can function as the valve hole 14 in which the valve member is accommodated. Stated otherwise, there is no particular need to perform a grinding process. By this amount, the number of process steps until the valve body 10, and thus the spool valve 12, is obtained is reduced. Therefore, a reduction in costs can be realized.

Furthermore, when casting is carried out while vibrations are imposed to the core pin surrounding region, there is an advantage in that burrs that are formed in the valve body 10 are made smaller in size. Since there is no need for a grinding process to be performed, and grinding dust is not generated, portions thereof that become scrap material are reduced. Therefore, material yield is enhanced.

In addition, due to vibrations being applied to the core pin surrounding region, the surface roughness of the inner wall (casting surface) of the valve hole 14 is reduced. More specifically, when the maximum surface roughness is measured at a plurality of arbitrary regions on the inner wall of the valve hole 14, the surface roughness is on the order of 1.5 μm or less.

Further, when vibrations are applied to the core pin surrounding region within the molten metal 66, air bubbles within the molten metal 66 are miniaturized by cavitation, together with such air bubbles moving in a direction away from the vibration source (the core pin 46). As a result, the inner layer in the vicinity of the core pin surrounding region (in the inner wall of the valve hole 14) is formed as a sound layer, in which casting defects having a size of a degree that causes leakage of hydraulic oil or the like are not recognized. It is noted that such miniaturized air bubbles have a size on the order of ø 0.1 mm.

Further, although the outer circumference of the shaft portion 82 of the core pin 46 is formed in a straight shape, portions thereof can be extracted away from the valve hole 14 without scoring or galling in the valve hole 14. Further, it is also possible to improve the circularity or roundness of the valve hole 14.

Figure 5:
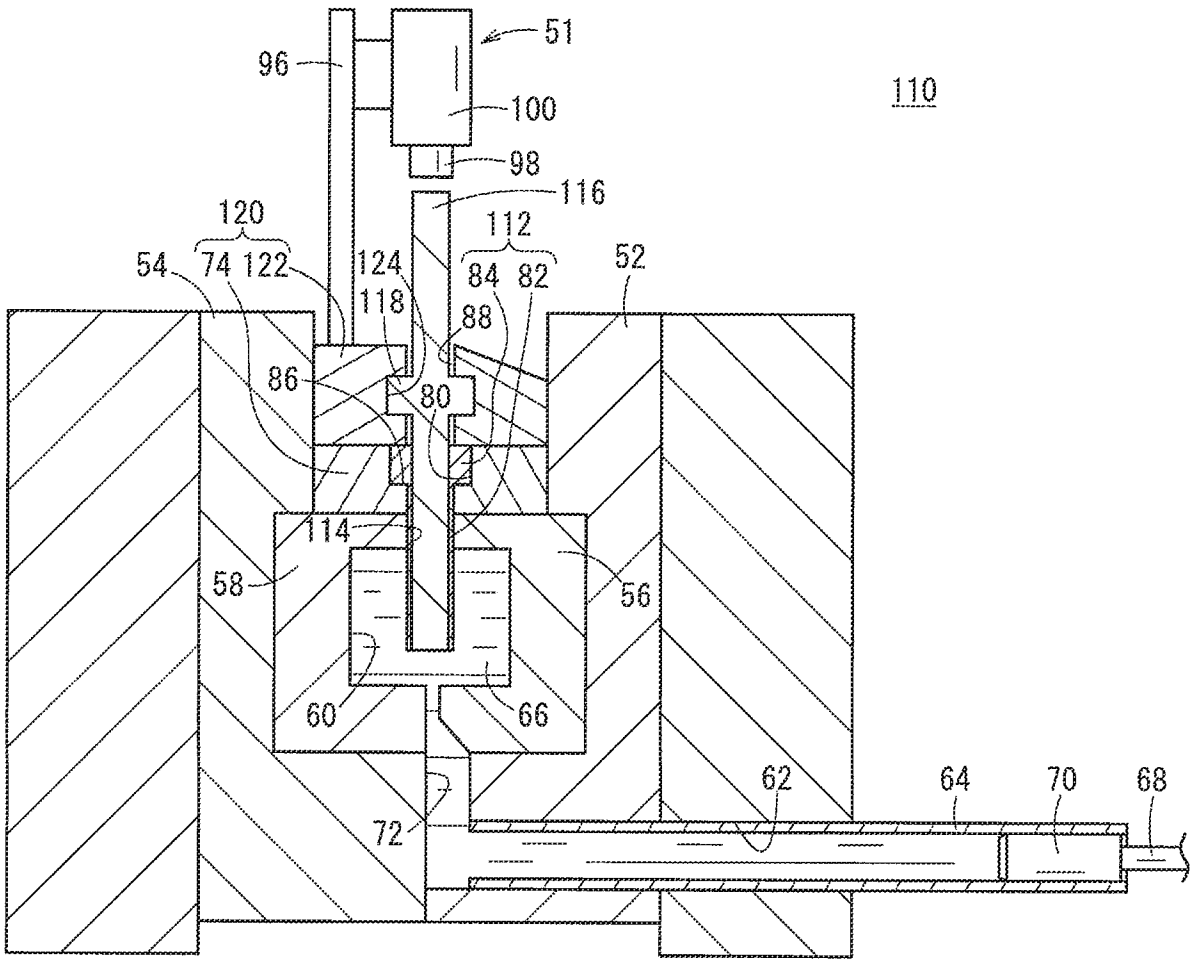
FIG. 5 is a vertical cross-sectional view of essential parts of a casting die device according to another embodiment.

According to a casting die device 110 shown in FIG. 5 as well, vibrations can be applied to the core pin surrounding region. The casting die device 110 will now be described. Constituent elements thereof, which are the same as the constituent elements shown in FIG. 4, are denoted, by the same reference characters, and detailed description of such items is omitted.

A core pin 112 that makes up the casting die device 110 is a hollow body, in which a loose insertion hole 114 that extends along the longitudinal direction is formed to penetrate therethrough. The core pin 112 is inserted into the stepped hole 80 that is formed in the pin retaining member 74, and in this case as well, a certain amount of play on the order of 0.01 to 0.1 mm is formed between the core pin 112 and the inner wall of the stepped hole 80.

In this case, the distal end of a vibration transmitting member 116 is inserted into the loose insertion hole 114 that is formed in the core pin 112. A certain amount of play on the order of 0.01 to 0.1 mm is formed between the side wall of the vibration transmitting member 116 and the inner wall of the loose insertion hole 114.

In a mid-flank portion in the longitudinal direction of the vibration transmitting member 116, a flange member 118 is provided that projects out in a diametral direction. The flange member 118 is formed on a strut supporting member 122 that constitutes a core 120, and is accommodated in a retaining hole 124 that makes up a portion of the through hole 88. More specifically, the strut supporting member 122 serves to retain the vibration transmitting member 116 in addition to the strut 96.

A certain amount of play on the order of 0.01 to 0.1 mm is formed between the vibration transmitting member 116 and the inner wall of the through hole 88, as well as between, the flange member 118 and the inner wall of the retaining hole 124. Consequently, the vibration transmitting member 116 can be subjected to swinging and rotating operations within the through hole 88 and the loose insertion hole 114.

An upper end part of the vibration transmitting member 116 projects out in an exposed manner from the through hole 88. The upper end surface thereof is arranged in a facing manner separated by a predetermined distance with respect to the lower end surface of the vibrating element 98 of the microvibration machine 100 that is retained on the strut 96.

In this case, at the time of the casting operation for obtaining the valve body 10, when the microvibration machine 100 is energized, the vibrating element 98 thereof is moved up and down at a predetermined period that is set in advance. At this time, the lower end surface of the vibrating element 98 is brought into abutment with or separated away from the upper end surface of the vibration transmitting member 116. By repeating this operation, vibrations are imparted to the vibration transmitting member 116 at a predetermined frequency (e.g., from one hundred to several hundreds Hz).

From the fact that the vibrating element 98 and the vibration transmitting member 116 are separated by a predetermined distance, collision energy is generated when the vibrating element 98 abuts against the vibration transmitting member 116. It is presumed that vibrations of a predetermined frequency to which such collision energy is added are imparted to the vibration transmitting member 116.

Since a certain amount of play is formed between the vibration transmitting member 116 and the inner wall of the through hole 88, as well as between the vibration transmitting member 116 and the inner wall of the loose insertion hole 114, the vibration transmitting member 116 is capable of being subjected to a swinging operation in the diametral direction, and a rotating operation in the circumferential direction. Vibrations in accordance with such operations are transmitted to the core pin 112.

Since play also is formed between the core pin 112 and the inner wall of the stepped hole 80, the core pin 112 is vibration transmitting member 116. The core pin 112 to which such vibrations are imparted is capable of being subjected to a swinging operation in the diametral direction, and a rotating operation in the circumferential direction.

At this time, since a gap (play) is formed between the inner wall of the loose insertion hole 114 of the core pin 112 and the outer circumference of the vibration transmitting member 116, sliding frictional heat is generated by the vibrations. Consequently, it is possible for the core pin 112 to generate heat. As a result, the molten metal running performance around the periphery of the core pin 112 can be improved.

Next, after a predetermined amount of the molten metal 66 has been introduced into the interior of the plunger sleeve 64 from the molten metal port in the same manner as described above, under an action of the non-illustrated injection cylinder, the plunger tip 70 is slid in a direction to press on the molten metal 66. Consequently, the molten metal 66 that is supplied to the interior of the plunger sleeve 64 is pushed out by the plunger tip 70, is guided in the runner 72, and reaches the cavity 60.

The molten metal 66 is supplied into the interior of the cavity 60, and thereafter, becomes hardened by solidification thereof. As a result, the valve body 10 is obtained having a shape that corresponds to the shape of the cavity 60. Further, the valve hole 14 is formed at a location corresponding to the core pin 112.

In this case, the core pin 112 enters into the cavity 60. Consequently, vibrations are imparted to the core pin surrounding region from the core pin 112 that is vibrated in the manner described above. In addition, from the distal end opening of the loose insertion hole 114 formed in the core pin 112, the vibration transmitting member 116 is repeatedly advanced (to project out from the core pin 112) and retracted (to enter into the interior of the core pin 112). At this time, the vibration transmitting member 116 abuts against and separates away from the core pin surrounding region. Due to this fact as well, vibrations are propagated to the core pin surrounding region.

Since the operations of swinging of the vibration transmitting member 116 and the core pin 112 in the diametral direction, and of rotating the vibration transmitting member 116 and the core pin 112 in the circumferential direction are easily carried out, vibrations can easily be propagated, in particular, with respect to the diametral direction or the circumferential direction of the core pin 112. Such imparting of vibrations is continued until die opening is carried out.

As a result of propagation of vibrations in this manner, the inner wall of the valve hole 14 exhibits a surface luster, and a casting surface can be formed, in which (casting defects, such as) blow holes or flow lines, etc., having a size of a degree that causes leakage of hydraulic oil are not recognized therein. In the casting surface, the plural lines 44 (see FIG. 3) are formed in a direction perpendicular to the axial direction (the extraction direction of the core pin 112).

Accordingly, there is no need to carry out an operation such as grinding or the like with respect to the inner wall (casting surface) of the valve hole 14, and the inner wall can function as the valve hole 14 in which the valve member is accommodated. Stated otherwise, there is no particular need to perform a grinding process. By this amount, the number of process steps until the valve body 10, and thus the spool valve 12, is obtained is reduced. Therefore, a reduction in costs can be realized.

Furthermore, also within a range covering a dimension of 1 mm in the depth direction from the casting surface, blow holes or flow lines (casting defects) having a size of a degree that causes leakage of hydraulic oil cannot be recognized. Further, the maximum surface roughness of the casting surface is 1.5 μm.

When vibrations are applied to the core pin surrounding region within the molten metal 66, air bubbles within the molten metal 66 are miniaturized by a cavitation phenomenon, together with such air bubbles moving in a direction away from the vibration source (the core pin 112 and the vibration transmitting member 116). As a result, the inner layer in the vicinity of the core pin surrounding region (in the inner wall of the valve hole 14) is formed as a sound layer, in which casting defects having a size of a degree that causes leakage of hydraulic oil or the like are not recognized. Such miniaturized air bubbles have a size on the order of ø 0.1 mm.

Figure 6:
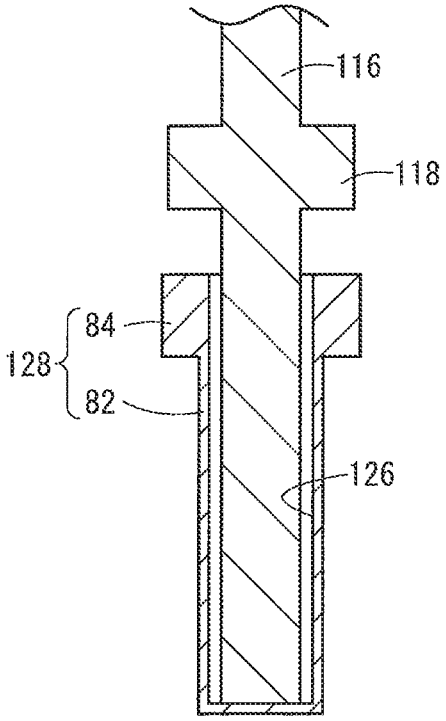
FIG. 6 is a vertical cross-sectional view of essential parts in which a core pin and a vibration transmitting member according to a modification are shown at an enlarged scale.

There is no particular necessity that the loose insertion hole 114 be formed as a penetrating hole. More specifically, as shown in FIG. 6, a core pin 128 may be adopted in which a loose insertion hole 126 is formed as a bottomed hole, and in which the vibration transmitting member 116 is made to undergo vibrations in the interior of the loose insertion hole 126.

In this case, the vibration transmitting member 116, which is vibrated, is repeatedly made to abut against or to separate away from the bottom wall of the core pin 128. Along therewith, vibrations are propagated to the core pin 128, and furthermore, are propagated to the core pin surrounding region. Consequently, the valve hole 14 is formed having an inner wall, which is made up from a casting surface having the same properties as described above.

Figure 7:
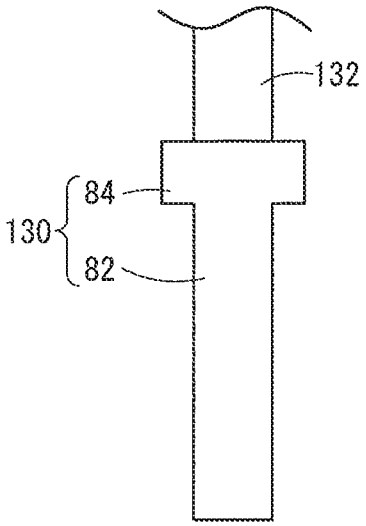
FIG. 7 is a vertical cross-sectional view of essential parts in which a core pin and a vibration transmitting member according to another modification are shown at an enlarged scale.

Alternatively, for example as shown in FIG. 7, a lower end surface of a vibration transmitting member 132 may be made to abut with respect to an upper end surface of the head portion 84 of a solid core pin 130 that is accommodated in the stepped hole 80.

In the above-described embodiments, although it has been described that mechanical vibrations are imparted having a frequency on the order of one hundred to several hundreds Hz, it is a matter of course that ultrasonic vibrations may also be imparted. In this case, instead of the microvibration machine 100, an ultrasonic vibration machine may be adopted. In addition, vibrations may be imparted a state in which the distal end of the vibrating element of the ultrasonic vibrating machine and the upper end surface of the vibration transmitting members 90, 116, 132 are in abutting contact and are not separated from one another.

Further, in the above-described embodiments, a case has been exemplified in which a grinding process applied with respect to the inner wall of the valve hole 14 is omitted, Stated otherwise, the casting surface itself is utilized as the inner wall. However, as may be necessary, a grinding process may be carried out with respect to the casting surface, so as to provide a new inner wall in which an interior portion thereof is exposed.

With the valve hole 14, which is obtained by application of vibrations, as described above, up to a depth of 1 mm from the inner wall (casting surface) thereof, a sound layer is provided in which casting defects having a size of a degree that causes leakage of hydraulic oil cannot be recognized. Therefore, for example, if a grinding process is performed thereon to remove a depth of up to 0.5 mm from the casting surface, a sound layer is exposed as a new surface (processed surface), i.e., a sound surface, together with the interior portion thereof up to a depth of 0.5 mm from the processed surface forming a sound layer. More specifically, in this case as well, it is possible to prevent leakage of hydraulic oil or the like.

Furthermore, the cast product, which is obtained in the manner described above, is not limited to being the valve body 10 of the spool valve 12, insofar as the cast product includes an inner bore that is formed by the core pin 46 or the like to which vibrations are applied. As another example of such a cast product, the body of an actuator may be presented. In this case, the inner bore, for example, is a sliding hole for a piston.

Further, as yet another example, there may be presented a throttle body or a carburetor body. In this case, the inner bore is an intake path, and the underlying material is air or an air-fuel mixture.

The invention claimed is:

1. A casting die device for obtaining a cast product by introducing a pressurized molten metal into a cavity, an inner bore being formed in the cast product, one end of the inner bore being open, the device comprising:

a die that forms a cavity;

a core pin configured to form the inner bore;

a vibration generating unit configured to generate vibrations; and a vibration transmitting member supported by the core pin and configured to transmit the vibrations generated by the vibration generating unit to the core pin an insert forming the cavity; a stationary die fixing the insert; a movable die displaceable to approach toward or separate away from the stationary die; a core disposed between the stationary die and the movable die, wherein the vibration generating unit and the vibration transmitting member are supported by the core, wherein the vibration generating unit includes a vibrating element configured to apply the vibrations to the vibration transmitting member, wherein the die supports the core pin such that a distal end of the core pin is positioned inside the cavity, and supports the vibration generating unit such that the vibrating element is separated from the core pin, and wherein the vibrating element is repeatedly carrying out abutment against and separation from the vibration transmitting member, thereby generating mechanical vibrations.

2. The casting die device according to claim 1, wherein the core pin and the vibration transmitting member are constituted as an integral structure made from same material.

* * * * *